US005341064A

United States Patent [19]

Seong

[11] Patent Number: 5,341,064

[45] Date of Patent: Aug. 23, 1994

[54] CATHODE ASSEMBLY OF AN ELECTRON GUN FOR A COLOR CATHODE RAY TUBE

[75] Inventor: Kwang-ki Seong, Kyungsangnam, Rep. of Korea

[73] Assignee: Samsung Electron Devices Co., Ltd., Kyungki, Rep. of Korea

[21] Appl. No.: 998,739

[22] Filed: Dec. 30, 1992

[30] Foreign Application Priority Data

Dec. 30, 1991 [KR] Rep. of Korea ..... 91-25437

[51] Int. Cl.[5] ..... H01J 29/46; H01J 1/94; H01J 19/48

[52] U.S. Cl. ..... 313/446; 313/417; 313/457; 313/270; 313/271; 313/456; 445/34

[58] Field of Search ..... 313/446, 417, 457, 270, 313/456, 458, 271, 344; 445/34

[56] References Cited

U.S. PATENT DOCUMENTS

| | | | |
|---|---|---|---|
| 4,044,278 | 8/1977 | Jariwala | 313/417 |
| 4,151,441 | 4/1979 | Puhak | 313/446 |
| 4,185,223 | 1/1980 | Anezaki | 313/446 |
| 4,931,691 | 6/1990 | Hale | 313/446 |
| 5,021,709 | 6/1991 | Oh | 313/446 |

FOREIGN PATENT DOCUMENTS 2920093 11/1980 Fed. Rep. of Germany ..... 313/446

*Primary Examiner*—Donald J. Yusko
*Assistant Examiner*—Matthew J. Esserman
*Attorney, Agent, or Firm*—Leydig, Voit & Mayer

[57] ABSTRACT

Disclosed is a cathode assembly of an electron gun for a color cathode ray tube in which a heater support structure is improved. The cathode assembly of an electron gun for a color cathode ray tube comprising three cylindrical sleeves which are arranged in an in-line type, a base metal which is located at the upper end of the sleeves, and of which the surfaces are coated with thermal electron emitting material, a heater which is located on the inner portion of each of the sleeves and having two parallel terminals which are exposed out of the sleeves, and a heater fixture block in which three pairs of welding terminals corresponding to the three heaters and two signal lines for forming an electrical circuit along with the welding terminals are provided in the lateral surface and two parallel bead glasses for supporting the sleeves and the block. The heater support structure is simple and the stability thereof is improved. Also, the heater is easily assembled to have a high productivity.

7 Claims, 4 Drawing Sheets

CATHODE ASSEMBLY OF AN ELECTRON GUN FOR A COLOR CATHODE RAY TUBE

BACKGROUND OF THE INVENTION

The present invention relates to a cathode assembly of an electron gun for a color cathode ray tube having an improved heater support structure, and more particularly to a cathode assembly of an electron gun for a color cathode ray tube, in which assembling of the heater is facilitated and stability in view of the structure is improved.

The electron gun for a color cathode ray tube (CRT) has three cathodes for generating three electron beams, and a plurality of grids and electrodes for controlling the electron beams. The cathode emits thermal electrons for producing the electron beams, having a thermal electron emitting material layer which is a thermal electron emitting source and a heater which is an energy source for heating the thermal electron emitting material layer.

The electron gun is provided at the rear end of a funnel which constitutes a vacuum vessel in cooperation with a panel, and shoots the electron beams on a screen provided in the funnel. Generally, at the rear side of the funnel is provided a cylindrical neck which houses the electron gun.

Referring to FIG. 1 which shows a part of an electron gun for a general CRT, the electron gun for the CRT includes cathode 8 which is a thermal electron emitting source, two grids G1 and G2 which produce the thermal electrons as electron beams, and a plurality of focus electrodes G3 and G4 for accelerating and collecting the electron beams. As shown in FIG.2, cathode 8 has a cylindrical sleeve 8*a* in which a heater 9 is internally installed, and a cap type base metal 8*b* of which the surfaces are coated with thermal electron emitting material 8*c*. A heater supporter 10 for supporting heater 9 in cathode 8 is located near the upper portion of a stem 7 having a plurality of lead pins 7*a* for electrical connections.

The above elements are located in a predetermined distance between two parallel bead glasses 6, and are fixed to bead glasses 6, to thereby form a complete electron gun.

In the electron gun having the above-mentioned structure, the fixed position of heater 9 which supplies the thermal energy to the cathode has a large influence on various properties of the entire electron gun. Accordingly, when heater 9 is welded in supporter 10, a high degree of precision is required.

However, since the conventional electron gun has a heat support structure of an inferior structural stability and degree of precision, the heater cannot be supported precisely and stably. Accordingly, the properties of the entire electron gun are adversely affected.

Referring to FIG. 3, the conventional heater supporter 10 has four Z-shaped fixed pieces 11 and 11' which are symmetrically installed between two pieces of bead glass 6 which are located in a predetermined distance from either side of heater supporter 10, two substantial V-shaped first connection pieces 12 which are welded in the free ends of first two fixed pieces 11, and two second connection pieces 13 which are welded in the free ends of second two fixed pieces 11'. The outer ends of first connection pieces 12 and the free ends of second connection pieces 13 are arranged such that there is sufficient space between them, so that both end terminals Ha of heater 9 can be welded and supported to the outer end of first connection pieces 12 and the free ends of second connection pieces 13. The inner ends of first connection pieces 12 are spaced similar to the spacing between the outer ends of first connection pieces 12 and the free ends of second connection pieces 13.

Such a heater supporter of a conventional electron gun for a CRT is composed of a number of components such as two pairs of fixed pieces, one pair of first connection pieces, one pair of second connection pieces, etc. Accordingly, the structure is complicated, the assembly work is difficult and the consumed manpower cost is high.

Also, since the fixed pieces and the first and second connection pieces have a number of bent portions, it is not only difficult to fix the heater at a predetermined position, but also it is difficult to fix the heater at the center of the sleeve of the cathode. Accordingly, the CRT is slow to provide an initial picture image, and the white balance is lowered.

SUMMARY OF THE INVENTION

The present invention is designed to solve the above-described problems. Accordingly, it is an object of the present invention to provide a cathode assembly of an electron gun for a color cathode ray tube in which a structure for supporting a heater is simple and the stability thereof is improved.

It is another object of the present invention to provide a cathode assembly of an electron gun for a color cathode ray tube in which a heater support structure is improved so that the heater is easily assembled to have a high productivity.

To achieve the above objects of the present invention, there is provided a cathode assembly of an electron gun for a color cathode ray tube comprising three cylindrical sleeves which are arranged in an in-line type, a base metal which is located at the upper end of the sleeves, and of which the surfaces are coated with thermal electron emitting material, three heaters which are located on the inner portion of each of the sleeves and having two parallel terminals which are exposed out of the sleeves, a heater fixture block in which three pairs of welding terminals corresponding to the three heaters and two signal lines for forming an electrical circuit along with the terminals are provided in the lateral surface, and two parallel bead glasses for supporting the sleeves and the block.

In a concrete embodiment of the present invention, the connection between the signal lines and the welding terminals can be constructed so that the three heaters are connected in parallel to one another or in series to one another. Thus, in the parallel connection structure, one electrode of each heater is commonly connected so as to be connected to one signal line, while the other electrode of each heater is commonly connected so as to be connected to the other signal line. On the other hand, in the serial connection structure, the three heaters are serially connected. The non-connection terminals of the respective heaters which are arranged in both outer sides and are not connected to each other are independently connected to both the signal lines.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

The cathode assembly according to the present invention is adapted in the conventional electron gun for a color cathode ray tube. Accordingly, the other elements except for the heater support structure which is explained hereinbelow have the same structures as those of the conventional electron gun. The electron gun to which the present invention is adapted has a cathode acting as a thermal electron emitting source, two grids for producing the thermal electrons as electron beams and a plurality of focus electrodes for accelerating and collecting the electron beams. The cathode has a cylindrical sleeve in which the heaters are internally installed and a cap-shaped base metal of the surfaces is coated with the thermal electron emitting material. A heater supporter for supporting the heaters in the cathode is located near the upper portion of a stem having a plurality of lead pins for electrical connections. The above elements are located in a predetermined distance between two parallel bead glasses, and are fixed to the bead glasses, to thereby form a complete electron gun. In addition to the above basic construction, the present invention has the heater structure having the features which are described below.

FIRST EMBODIMENT

Figure 1:
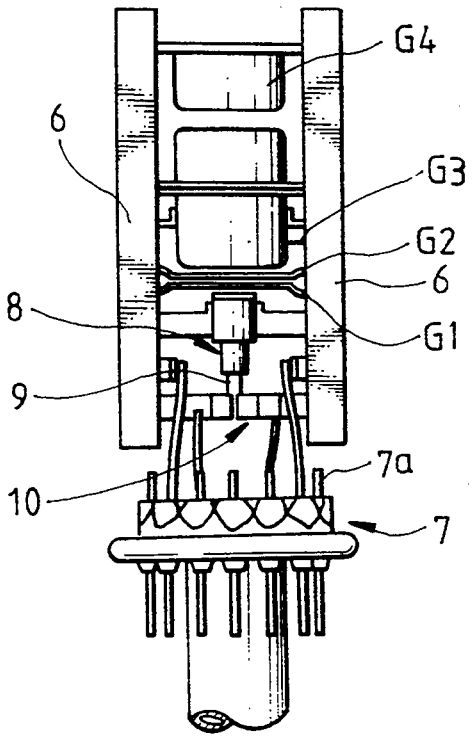
FIG.1(PRIOR ART)
FIG. 1 is a partially exploded side view of a conventional electron gun for a color cathode ray tube.
Figure 2:
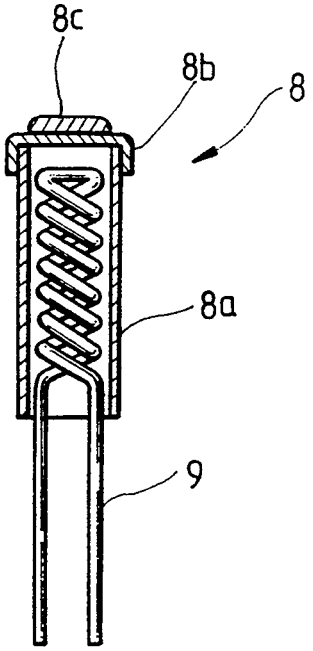
FIG.2(PRIOR ART)
FIG. 2 is a sectional view of a conventional cathode assembly of an electron gun for a color cathode ray tube.
Figure 3:
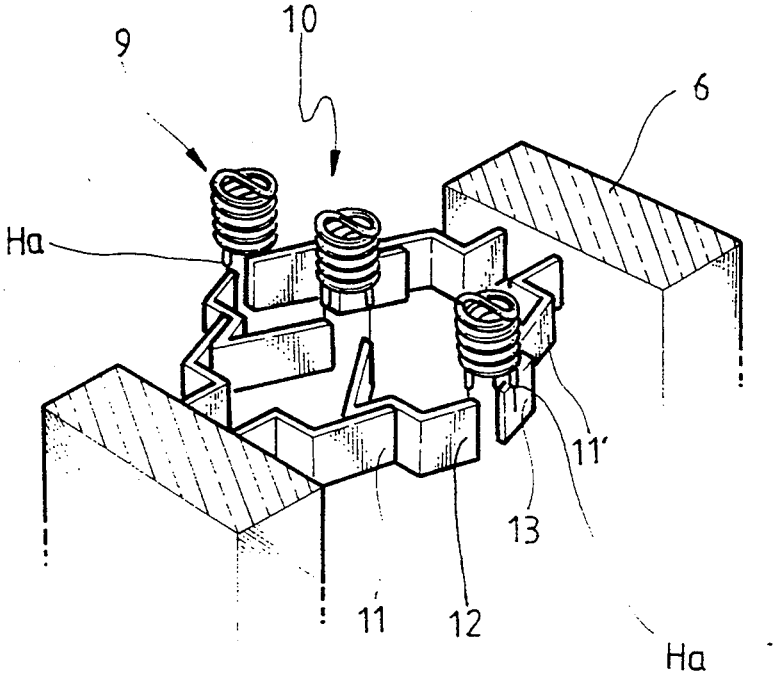
FIG.3(PRIOR ART)
FIG. 3 is an extracted perspective view of a conventional heater assembly of an electron gun for the color cathode ray tube.
Figure 4:
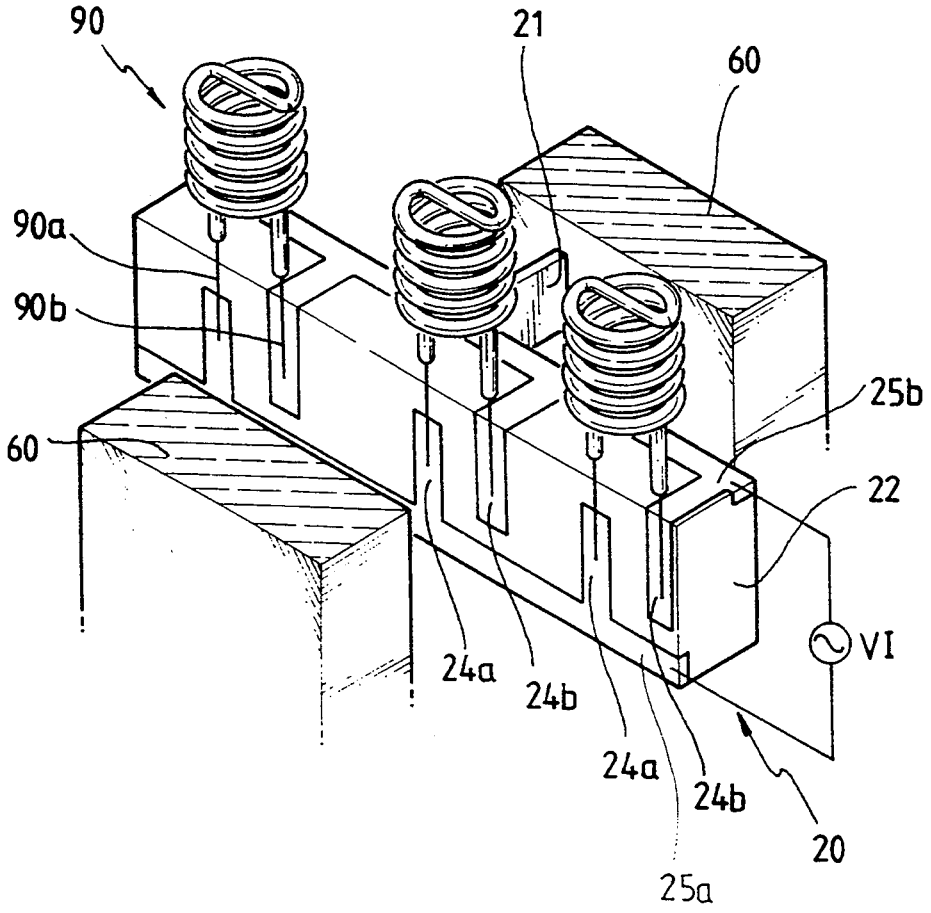
FIG. 4 is a perspective view of a heater support structure for a cathode assembly of an electron gun for a color cathode ray tube according to one embodiment of the present invention.

FIG. 4 shows a preferred embodiment of the present invention having a structure in which the heaters are connected in parallel to one another.

As shown in FIG. 4, a heater supporter 20 comprises three pairs of welding terminals 24*a* and 24*b* corresponding to the three heaters, a heater fixture block 22 in which two signal lines 25*a* and 25*b* for forming an electrical circuit along with welding terminals 24*a* and 24*b* are provided in the upper and lateral surfaces. At both sides of fixture block 22 are provided bead glasses 60. Fixture block 22 is fixed to bead glasses 60 by means of fixing pieces 21.

Welding terminals 24*a* and 24*b* are separated from each other by a predetermined distance and formed in parallel to each other on the lateral surface of fixture block 22. Terminals 90*a* and 90*b* of heater 90 are respectively welded in respective adjacent welding terminals 24*a* and 24*b*. Among the respective pairs of welding terminals 24*a* and 24*b* and heater terminals 90*a* and 90*b*, one welding terminal 24*a* and one heater terminal 90*a* are commonly connected to one signal line 25*a*, while the other welding terminal 24*b* and the other heat terminal 90*b* are commonly connected to the other signal line 25*b*. Thus, the above heaters have the parallel connection structure, to thereby be applied with a voltage V1 which is applied to both the signal lines 25*a* and 25*b*.

The distance between welding terminals 24*a* and 24*b* is determined depending on the distance between both the respective terminals 90*a* and 90*b* of heaters 90 and the mutual distance between heaters 90. Each of the signal lines and the welding terminals have a thickness in the range of 0.1–2.0 Omm. The thicker the signal lines and the welding terminals the more advantageous they are Therefore, the welding terminals and the signal lines are buried in a predetermined depth in the fixture block, and are provided in the fixture block so that only the surfaces of the welding terminals and the signal lines are exposed. In the described embodiment the dimensions of the fixture block are 5 mm×7 mm×18 mm.

One or more fixing pieces 21 for fixing the fixture block in bead glasses 60 can be provided. The fixture block can be fixed on either side of bead glasses or on both sides thereof.

SECOND EMBODIMENT

Figure 5:
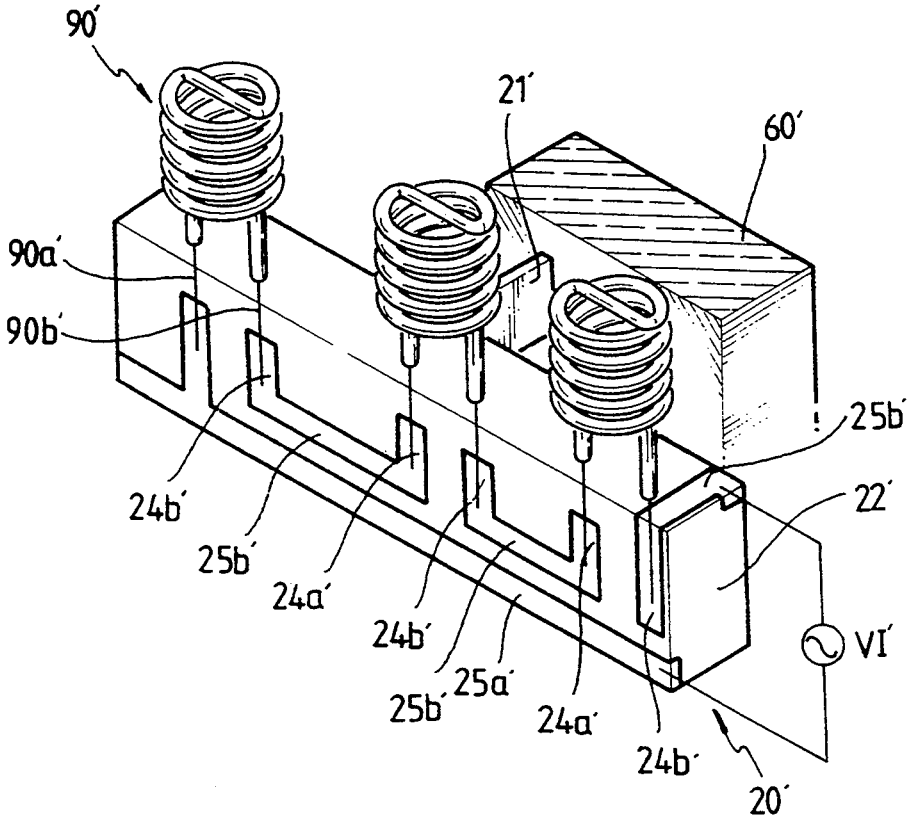
FIG. 5 is an extracted perspective view of a heater support structure for a cathode assembly of an electron gun for a color cathode ray tube according to another embodiment of the present invention.

FIG. 5 shows another preferred embodiment of the present invention having another structure in which the heaters are connected in series to one another.

As shown in FIG. 5, a heater supporter 20' comprises three pairs of welding terminals 24*a'* and 24*b'* corresponding to the three heaters, a heater fixture block 22' in which two signal lines 25*a'* and 25*b'* for forming an electrical circuit along with welding terminals 24*a'* and 24*b'* are provided in the upper and lateral surfaces. On both sides of fixture block 22' are provided bead glasses 60' Fixture block 22' is fixed to bead glasses 60' by means of fixing pieces 21'.

Welding terminals 24*a'* and 24*b'* are spaced apart from each other by a predetermined distance and formed in parallel to each other on the lateral surface of fixture block 22'. Terminals 90*a'* and 90*b'* of heater 90' are respectively welded in respective adjacent welding terminals 24*a'* and 24*b'* Two pairs of welding terminals 24*a'* and 24*b'* except for both the outer welding terminals are connected by two signal lines 25*b'*, to have heaters 90' connected in series. Thus, the above heaters have the series connection structure, to thereby be applied with one-third times a voltage V1' which is applied to both signal lines 25*a'* and 25*b'*.

In the second embodiment, the distance between welding terminals 24*a'* and 24*b'* is determined depending on the distance between both the respective terminals 90*a'* and 90*b'* of heaters 90' and the mutual distance between heaters 90'. Also, each of the signal lines and the welding terminals have a predetermined thickness. The thicker the welding terminals and the signal lines are, the more advantageous they are. Therefore, the welding terminals and the signal lines are buried in a predetermined depth in the fixture block, and are provided in the fixture block so that only the surfaces of the welding terminals and the signal lines are exposed thereon. The dimensions of the welding terminals, the signal lines and the heater fixture block in this embodiment are the same as those in the first embodiment.

One or more fixing pieces 21' for fixing the fixture block in bead glasses 60' can be provided. The fixture block can be fixed on either side of bead glasses or on both sides thereof.

Figure 6:
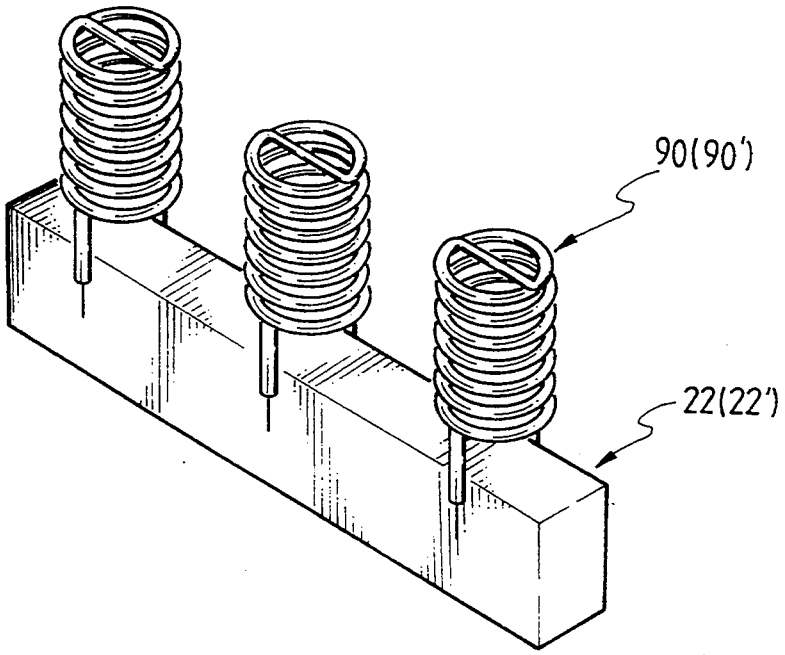
FIG. 6 is a schematically extracted perspective view of a heater support structure for a cathode assembly of an electron gun for a color cathode ray tube according to yet another embodiment of the present invention.
Figure 7:
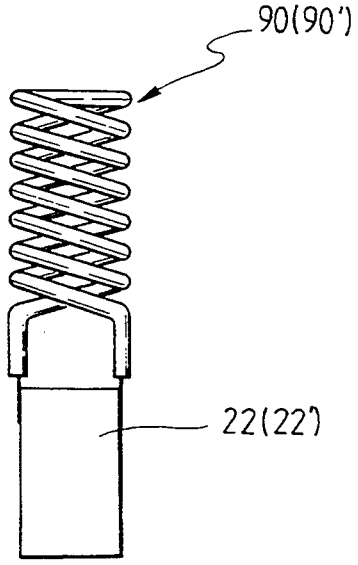
FIG. 7 is a front view of the heater support structure shown in FIG. 6.

The above-described embodiments can be varied in a configuration shown in FIGS. 6 and 7. That is, the heater terminals can be fixed on both sides of fixing blocks 22 and 22', respectively. Thus, in such a structure, the signal lines and the welding terminals should be separately arranged on both sides of fixing blocks 22 and 22'. Here, when the connection structure of the welding terminals and the signal lines are properly varied, the heater support structure of the serial or parallel connection structure can be obtained.

As described above, since the present invention has a structure that a plurality of heaters are fixed in a single fixture block, the entire structure is not only simple, but also the assembly and welding works are very convenient. The heater structure according to the present invention has a high stability, and particularly it is possible to determine a precise position of the heaters. Thus, the performance of the electron gun can be improved.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A cathode assembly of an electron gun for a color cathode ray tube comprising:

three cylindrical sleeves which are arranged in an in-line type;

a base metal which is located at the upper end of said sleeves, and of which the surfaces are coated with thermal electron emitting material;

one heater which is located on the inner portion of each of said sleeves and having two parallel terminals which are exposed out of said sleeves;

a heater fixture block in which three pairs of welding terminals corresponding to the three heaters and two signal lines for forming an electrical circuit along with said welding terminals are provided in a lateral surface; and two parallel bead glasses for supporting said sleeves and said block.

2. The cathode assembly of an electron gun for a color cathode ray tube according to claim 1, wherein connection between said signal lines and said welding terminals is constructed so that said three heaters are connected in parallel to one another.

3. The cathode assembly of an electron gun for a color cathode ray tube according to claim 2, wherein said welding terminals are arranged so that terminals of said respective heaters are located on opposing lateral surfaces of said fixture block.

4. The cathode assembly of an electron gun for a color cathode ray tube according to claim 1, wherein connection between said signal lines and said welding terminals is constructed so that said three heaters are connected in series to one another.

5. The cathode assembly of an electron gun for a color cathode ray tube according to claim 4, wherein said welding terminals are arranged so that terminals of said respective heaters are located on opposing lateral surfaces of said fixture block.

6. A cathode assembly of an electron gun for a color cathode ray tube comprising:

a heater fixture block;

first and second signal lines disposed in said heater fixture block;

a plurality of pairs of welding terminals disposed in said heater fixture block, each pair of welding terminals including a first welding terminal which is connected to said first signal line and a second welding terminal which is connected to said second signal line such that the plurality of welding terminals are connected to each other in parallel; and a plurality of heating members, each heating member having a first terminal which is electrically connected to a respective first welding terminal and a second terminal which is electrically connected to a respective second welding terminal.

7. A cathode assembly of an electron gun for a color cathode ray tube comprising:

a heater fixture block;

a first signal line disposed in said heater fixture block;

a plurality of pairs of welding terminals disposed in said heater fixture block, each pair of welding terminals including a first welding terminal and a second welding terminal, said first signal line connected to a first welding terminal of a first one of said pairs of welding terminals; a second signal line comprising a plurality of segments, each segment connecting a first terminal of one of said pairs of welding terminals with a second terminal of another of said pairs of welding terminals such that said plurality of pairs of welding terminals are connected to each other in series; and a plurality of heating members, each heating member having a first terminal which is electrically connected to a respective first welding terminal and a second terminal which is electrically connected to a respective second welding terminal.

* * * * *